US007765933B2

(12) United States Patent
Poore et al.

(10) Patent No.: US 7,765,933 B2
(45) Date of Patent: Aug. 3, 2010

(54) SHOTSHELL WITH SHOT PELLETS HAVING MULTIPLE SHAPES

(75) Inventors: Rochelle Diane Poore, Andover, MN (US); Drew Lee Goodlin, Isanti, MN (US); Lawrence Peter Head, Cambridge, MN (US)

(73) Assignee: Alliant Techsystems Inc., Minneapolis, MN (US)

( * ) Notice: Subject to any disclaimer, the term of this patent is extended or adjusted under 35 U.S.C. 154(b) by 0 days.

(21) Appl. No.: 11/936,012

(22) Filed: Nov. 6, 2007

(65) Prior Publication Data

US 2009/0114113 A1 May 7, 2009

(51) Int. Cl.
*F42B 7/02* (2006.01)

(52) U.S. Cl. ..... 102/460; 102/439; 102/448; 102/454; 102/457

(58) Field of Classification Search ..... 102/454, 102/455, 457, 458, 460, 449, 438, 439; 86/54, 86/57

See application file for complete search history.

(56) References Cited

U.S. PATENT DOCUMENTS 1,583,559 A * 5/1926 Kenneweg ..... 102/460
3,412,681 A * 11/1968 Schirneker ..... 102/438
3,952,659 A * 4/1976 Sistino ..... 102/453
3,996,865 A * 12/1976 Dwyer ..... 47/1.01 R
4,473,514 A 9/1984 Donn
4,686,904 A * 8/1987 Stafford ..... 102/439
4,760,793 A 8/1988 Herring, III
4,823,702 A * 4/1989 Woolsey ..... 102/502
4,996,924 A * 3/1991 McClain ..... 102/501
5,020,438 A * 6/1991 Brown ..... 102/517
5,264,022 A 11/1993 Haygarth et al.
5,325,786 A * 7/1994 Petrovich ..... 102/438
5,527,376 A * 6/1996 Amick et al. ..... 75/246
5,540,749 A 7/1996 Li et al.
5,874,689 A 2/1999 Alkhatib et al.
6,202,561 B1 * 3/2001 Head et al. ..... 102/460
6,367,388 B1 4/2002 Billings
6,415,719 B1 7/2002 Buccelli et al.
6,916,354 B2 7/2005 Elliott
7,017,495 B2 3/2006 Sexton
7,232,473 B2 6/2007 Elliott

* cited by examiner

*Primary Examiner*—James S Bergin
*Assistant Examiner*—Daniel J Troy
(74) *Attorney, Agent, or Firm*—Vidas, Arrett & Steinkraus, P.A.

(57) ABSTRACT

In at least one embodiment, a shotshell comprises a casing defining an internal chamber, a plurality of first shot pellets within the internal chamber and a plurality of second shot pellets within the internal chamber. The first shot pellets comprise a first shape and the second shot pellets comprise a second shape that is different from the first shape.

22 Claims, 3 Drawing Sheets

SHOTSHELL WITH SHOT PELLETS HAVING MULTIPLE SHAPES

FIELD OF THE INVENTION

This invention relates generally to the field of shotshells, and more particularly to a shotshell having fill comprising pellets of varying shape.

BACKGROUND OF THE INVENTION

Shotshells are well known in the art, and are available in many different configurations. Shotshells are typically filled with shot of a uniform size, classified according to the nominal diameter of the shot. Standard sizes have developed, for example ranging from BBB (0.19" dia) to 3 (0.14" dia) to 9 (0.08" dia), as would be recognized by a person of ordinary skill in the art.

The shot size can be selected according to the specifics of the target. For example, when hunting upland game, such as pheasants and grouse, at closer ranges, shotshells having a smaller shot can be desirable to achieve a greater shot spread. When hunting waterfowl at longer ranges, larger shot can be desirable, which can achieve a narrower shot spread and carry more energy to the target.

The shot spread and pattern density are often used to evaluate shotshells. Prior art shotshells tend to create shot patterns that are not evenly dispersed, for example having a higher density than necessary at the core of the pattern while exhibiting too light a density to be effective in the remaining areas of the shot pattern located outside the core.

There remains a need for shotshells that exhibit a more consistent and effective pattern density across a greater area.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In at least one embodiment, a shotshell comprises a casing defining an internal chamber, a plurality of first shot pellets within the internal chamber and a plurality of second shot pellets within the internal chamber. The first shot pellets comprise a first shape and the second shot pellets comprise a second shape that is different from the first shape.

In some embodiments, the second shot pellets have a higher drag coefficient than the first shot pellets.

In some embodiments, the second shot pellets are non-spherical. In some embodiments, both the first and second shot pellets are non-spherical.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

DETAILED DESCRIPTION OF THE INVENTION

Figure 1:
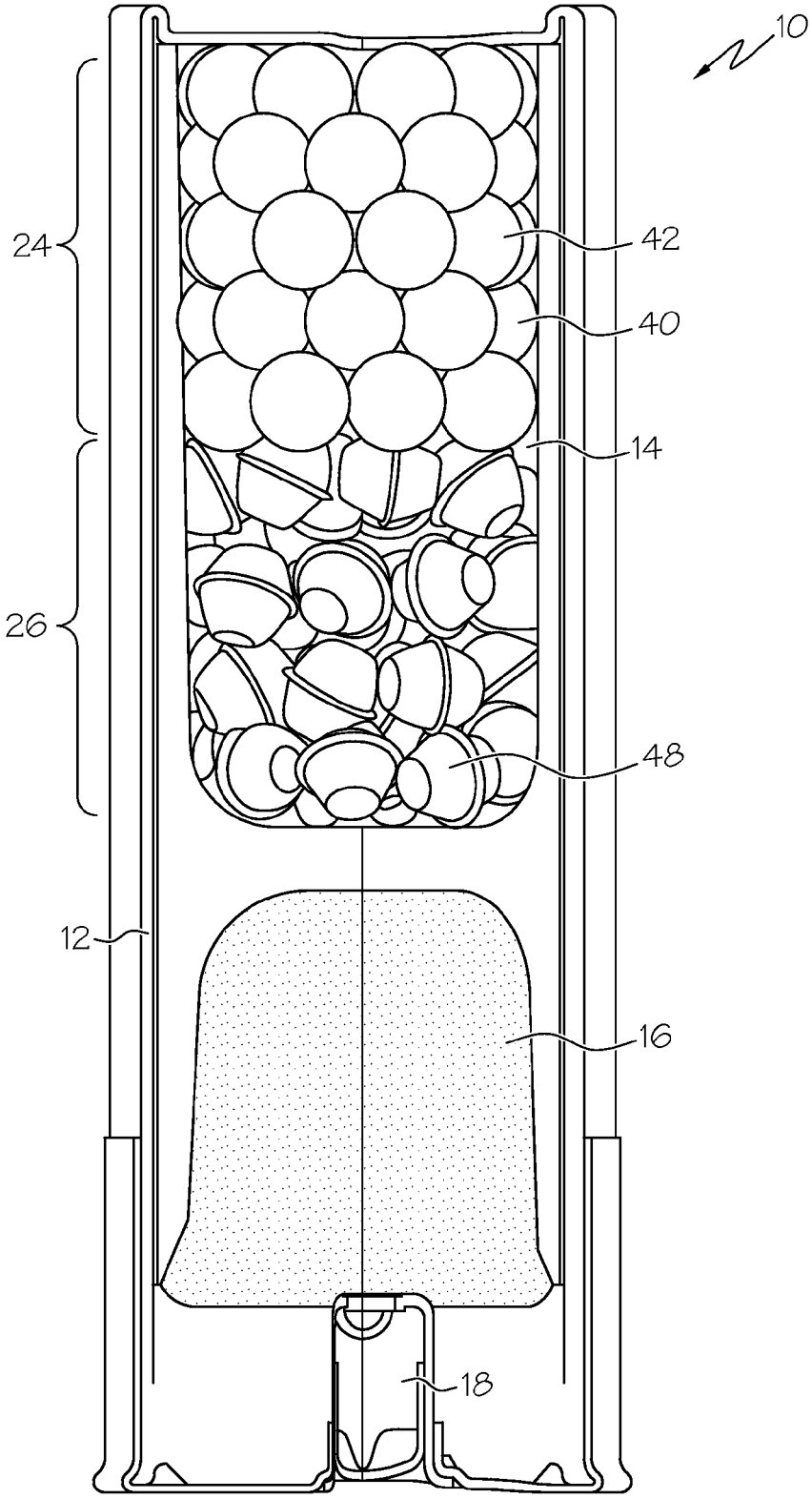
FIG. 1 shows a cross-sectional view of an embodiment of a shotshell.

While this invention may be embodied in many forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an inventive shotshell 10, comprising a casing 12 defining an internal chamber 14. The shotshell 10 also includes propellant 16 and a primer 18.

The internal chamber 14 is filled with shot pellets 40 including a plurality of first shot pellets 42 and a plurality of second shot pellets 48. Desirably, the first shot pellets 42 comprise a shape that is different from the shape of the second shot pellets 48. For example, the three-dimensional geometric shape can be different. Desirably, the drag coefficient of the second shot pellets 48 is greater than the drag coefficient of the first shot pellets 42. This causes the second shot pellets 48 to tumble and spread more than the first shot pellets 42.

The first shot pellets 42 are of any suitable shape, and in some embodiments are ordinary shot having a spherical shape. In some embodiments, the first shot pellets 42 can be non-spherical. All of the shot pellets 40 within the plurality of first shot pellets 42 are desirably uniform in shape and design.

The second shot pellets 48 can be any suitable shape that is geometrically different from the first shot pellets 42. Preferably, the second shot pellets 48 are non-spherical. All of the shot pellets 40 within the plurality of second shot pellets 48 are uniform in shape and design. In some embodiments, a cross-sectional shape of a first shot pellet 42 is different from a cross-sectional shape of a second shot pellet 48.

Figure 2:
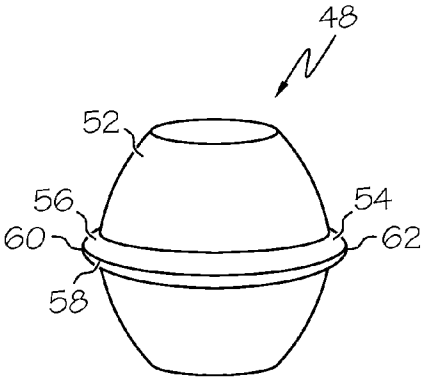
FIG. 2 shows an embodiment of a shaped shot pellet for use in a shotshell.

FIG. 2 shows an embodiment of a second shot pellet 48. In some embodiments, a second shot pellet 48 comprises a body portion 52 and a raised ridge 54 that extends around the body portion 52. In some embodiments, a second shot pellet 48 comprises a first flat portion 56 and a second flat portion 58 that meet at an angle 60. In some embodiments, a second shot pellet 48 comprises a raised edge 62 that can be sharp. In some embodiments, a second shot pellet 48 comprises surface features that create a greater amount of drag when compared to the first shot pellet 42. In some embodiments, a second shot pellet 48 has a shape that will tumble in the air, such that its effective drag coefficient will change as it tumbles.

The surface features of the second shot pellet 48 serve multiple purposes. First, the added drag causes the second shot pellets 48 to spread more quickly and more uniformly when compared to prior art spherical shot of the same size. Also, raised edges 62 can cut into a target and be more effective than prior art shot.

Figure 3:
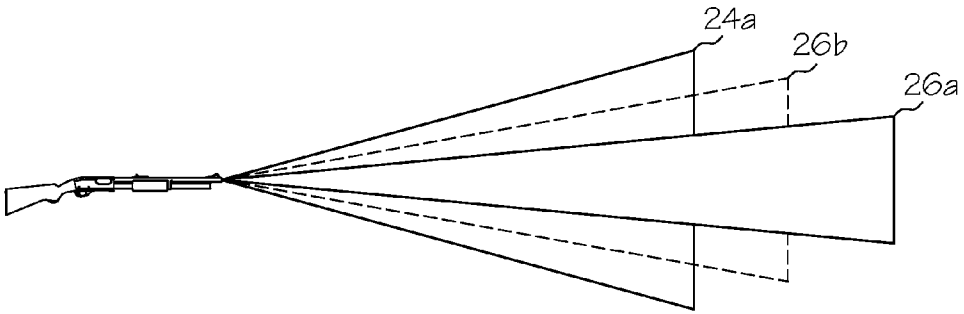
FIG. 3 compares the spread pattern of spherical shot (see 26*a*) and an embodiment of shaped shot (see 26*b*).

FIG. 3 illustrates an example of increased spread when using the second shot pellets 48. Referring to FIG. 1, it should be noted that the shell chamber 14 comprises a front portion 24 and a rear portion 26. When a single type of shot is used, for example if the front 24 and a rear 26 portions were both filled with the first shot pellets 42, shot located in the front portion 24 is expected to spread more, as indicated by cone 24*a* in FIG. 3. Shot located in the rear portion 26 is expected to spread less, as indicated by cone 26*a* in FIG. 3. The average result is a high shot density in the core of the shot pattern and lower density towards the outer periphery.

When the rear portion 26 is filled with the second shot pellets 48, the increased spread of the second shot pellets 48 lessens shot density in the core and increases density toward the outer periphery, as indicated by cone 26*b*. Thus, the shot density in the core is decreased somewhat while still being lethal, while the shot density in the periphery is increased to more desirable levels, increasing the effective lethal diameter of the shot.

In some embodiments, the rear portion 26 (see FIG. 1) can be filled with second shot pellets 48 to comprise 40% of the load. The front portion 24 can be filled with first shot pellets 42 to comprise the remaining 60% of the load. Shells of this nature were tested as indicated below. While these percentages refer to weight, they could alternatively refer to volume.

An embodiment of a test shell having 40% second shot pellets 48 loaded toward the rear of the shell and 60% first shot pellets 42 loaded toward the front of the shell was compared to a control shell loaded with 100% spherical shot of similar size. The test measured shot pattern density using a 30 inch diameter target at 40 yards. Shot density for the 15 inch diameter core of the target was also calculated, and the core density was compared to the overall density. The control shell exhibited a higher concentration of hits in the core, and the pattern density in the core area was approximately 1.5 times the overall density. The test shell exhibited a lower concentration of hits in the core, and the pattern density in the core was approximately 1.2 times the overall density. Thus, the test shell exhibited a lower core density and a more uniform shot spread across the overall target.

In some embodiments, the second shot pellets 48 comprise shapes that are ordinarily formed during the process of making spherical shot. For example, at least one process exists where the second shot pellets 48 illustrated in FIG. 2 comprise a preliminary shot shape that is ground to form a spherical shape. By using these preliminary shapes as the second shot pellets 48, the inventive shotshells 10 also provide an economic advantage over prior art shells, as the number of steps required to manufacture the second shot pellets 48 is reduced.

Figure 4:
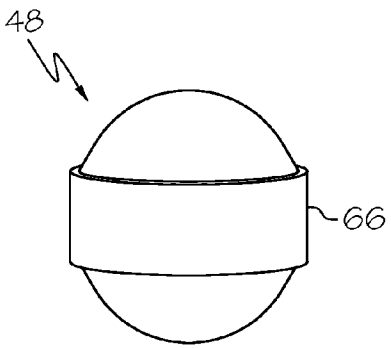
FIG. 4 shows another embodiment of a shaped shot pellet.

FIG. 4 shows another embodiment for the second shot pellets 48. In some embodiments, the second shot pellets 48 comprise a cylindrical portion 66.

Figure 5:
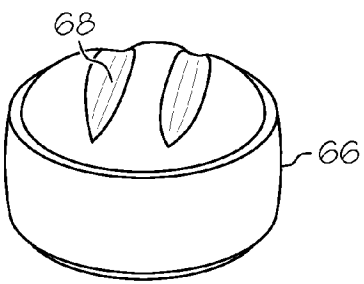
FIG. 5 shows another embodiment of a shaped shot pellet.

FIG. 5 shows another embodiment for the second shot pellets 48. In some embodiments, the second shot pellets 48 comprise one or more grooves 68.

Other embodiments of shaped shot pellets can comprise any suitable shape. For example, in various embodiments a pellet can comprise an oval/football shape, a teardrop shape, a square/rectangular/box shape, or any other suitable variation.

Although the shaped shot pellets discussed herein are generally referred to as the second shot pellets 48, it should be noted that any of the shaped pellets could also be used as the first shot pellets 42. For example, FIG. 6 shows an embodiment where both the first shot pellets 42 and the second shot pellets 48 are non-spherical.

Figure 6:
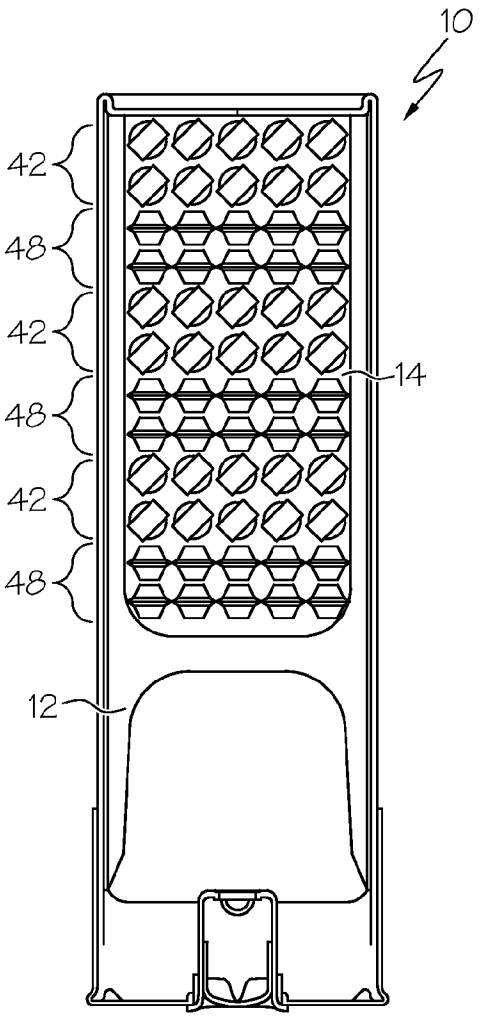
FIG. 6 shows a cross-sectional view of another embodiment of a shotshell.

FIG. 6 shows an embodiment of a shotshell 10 wherein the first shot pellets 42 and the second shot pellets 48 are grouped in layers that alternate along the length of the shotshell 10. FIG. 6 illustrates six total layers comprising three layers of first shot pellets 42 and three layers of second shot pellets 48. Various embodiments of a shotshell 10 can comprise any suitable number of layers. For example, FIG. 1 illustrates a total of two layers, one of each type of pellet 42, 48. The invention also comprises odd numbers of layers, such as three, five or seven layers total. For example, in a three layer embodiment, a shotshell 10 can comprise a layer of second shot pellets 48 at the rear of the chamber 14, a layer of first shot pellets 42 in a central portion of the chamber 14, and another layer of second shot pellets 48 at the front of the chamber 14.

Figure 7:
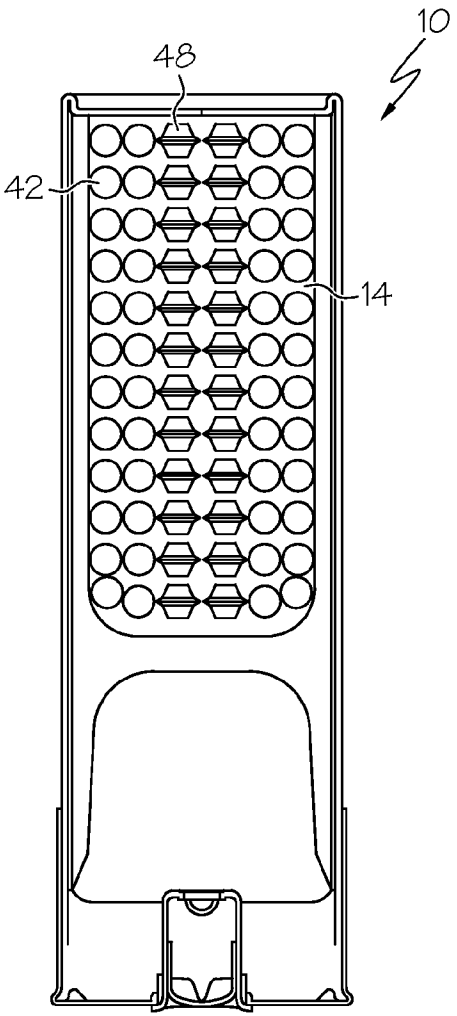
FIG. 7 shows a cross-sectional view of another embodiment of a shotshell.

FIG. 7 shows another embodiment of a shotshell 10, wherein the first shot pellets 42 and the second shot pellets 48 are radially separated. The second shot pellets 48 occupy the radial core of the chamber 14 and comprise a column that extends along the length of the shotshell 10. The first shot pellets 42 occupy the remaining portion of the chamber 14, comprising a tubular shape that extends around the column of second shot pellets 48.

Figure 8:
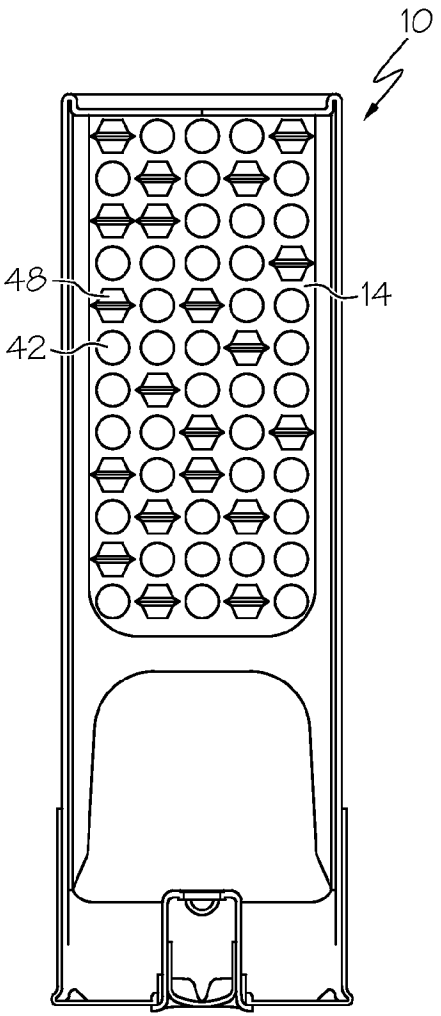
FIG. 8 shows a cross-sectional view of another embodiment of a shotshell.

FIG. 8 shows another embodiment of a shotshell 10 wherein first shot pellets 42 and second shot pellets 48 are randomly distributed throughout the chamber 14. This embodiment still produces a desirable shot spread, as the second shot pellets 48 will spread more than spherical shot.

In other embodiments wherein first shot pellets 42 and second shot pellets 48 are distributed together in the chamber 14, first shot pellets 42 and second shot pellets 48 can be evenly mixed.

In some embodiments, the second shot pellets 48 can be loaded in the front of the chamber 14. For example, when hunting upland game such as grouse and pheasants, a large spread as soon as possible is desirable. By placing the second shot pellets 48 at the front of the chamber 14, the initial spread of the shot is increased.

In some embodiments, various wads can be used to separate the first shot pellets 42 and second shot pellets 48. For example, a wad can include a plurality of chambers, and different types of shot can be placed in the various chambers.

The first shot pellets 42 and second shot pellets 48 can be combined using any suitable relative quantity. In some embodiments, first shot pellets 42 can comprise 50% of the shot load, and second shot pellets 48 can comprise 50% of the shot load. Other quantities can be used, such as 60/40, 70/30, etc. Various embodiments can utilize more first shot pellets 42 than second shot pellets 48, or more second shot pellets 48 than first shot pellets 42.

In some embodiments, the first shot pellets 42 comprise the same size shot as the second shot pellets 48. In some embodiments, the first shot pellets 42 can be of a first size and the second shot pellets 48 can be of a second size different from the first size, for example being larger or smaller. The specific sizes can be adjusted to create the desired shot spread and density patterns. U.S. Pat. No. 4,760,793, incorporated herein by reference in its entirety, discusses combining multiple sizes of spherical shot.

In some embodiments, the first shot pellets 42 comprise the same density shot as the second shot pellets 48. In some embodiments, the first shot pellets 42 can be of a first density and the second shot pellets 48 can be of a second density different from the first density, for example being greater or lesser. The specific densities can be adjusted to create the desired shot spread and density patterns. U.S. Pat. No. 6,202,561, incorporated herein by reference in its entirety, discusses combining multiple densities of spherical shot.

In some embodiments, the first shot pellets 42 comprise a size that is different from the size of the second shot pellets 48, and a density that is different from the density of the second shot pellets 48.

In some embodiments, additional shaped shot pellets can be used. For example, first shot pellets 42 can comprise a first shape, second shot pellets 48 can comprise a second shape, and third shot pellets (not shown) can comprise a third shape. Any suitable number of various shapes can be used within an inventive shotshell 10.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

What is claimed is:

1. A shotshell comprising:

a casing defining an internal chamber;

a plurality of first shot pellets within the internal chamber, said first shot pellets comprising a first shape; and a plurality of second shot pellets within the internal chamber, said second shot pellets comprising a second shape that is different from the first shape, said second shape comprising a raised ridge and flat opposed end portions, a cross-section taken through said raised ridge having a circular shape, said second shape being symmetric across said cross-section.

2. The shotshell of claim 1, wherein a drag coefficient of a second shot pellet is greater than a drag coefficient of a first shot pellet.

3. The shotshell of claim 1, wherein said cross-section defines a largest diameter of said second shape.

4. The shotshell of claim 3, wherein said first shot pellets are spherical.

5. The shotshell of claim 1, wherein said first shot pellets are non-spherical.

6. The shotshell of claim 1, wherein said second shot pellets comprise a sharp edge.

7. The shotshell of claim 1, wherein said second shot pellets comprise a cylindrical portion.

8. The shotshell of claim 1, wherein said raised ridge comprises first and second flat portions.

9. The shotshell of claim 1, wherein said second shot pellets are asymmetric across at least one axis.

10. The shotshell of claim 1, wherein said first shot pellets comprise 60% of the shot load and said second shot pellets comprise 40% of the shot load.

11. The shotshell of claim 1, wherein said first shot pellets are grouped toward the front of the internal chamber and said second shot pellets are grouped toward the rear of the internal chamber.

12. The shotshell of claim 1, wherein said first shot pellets are grouped toward the rear of the internal chamber and said second shot pellets are grouped toward the front of the internal chamber.

13. The shotshell of claim 1, wherein said first and second shot pellets are evenly distributed throughout the internal chamber.

14. The shotshell of claim 1, wherein said first and second shot pellets are non-toxic.

15. The shotshell of claim 1, wherein said first and second shot pellets comprise steel.

16. The shotshell of claim 1, comprising layers of first shot pellets and second shot pellets.

17. The shotshell of claim 1, wherein the first shot pellets and second shot pellets are commingled within said internal chamber.

18. The shotshell of claim 1, wherein the first shot pellets are radially separated from the second shot pellets.

19. The shotshell of claim 1, wherein said second shot pellets comprise a single raised ridge.

20. The shotshell of claim 1, wherein said raised ridge consists of first and second flat portions.

21. The shotshell of claim 1, wherein said second shot pellets spread more than said first shot pellets when the shotshell is fired.

22. A shotshell comprising:

a casing defining an internal chamber;

a plurality of first shot pellets within the internal chamber, said first shot pellets comprising a first shape; and a plurality of second shot pellets within the internal chamber, each second shot pellet comprising a non-spherical shape having a raised ridge and flat opposed end portions, wherein a cross-section of said second shot pellet taken through said raised ridge is circular.

* * * * *